US009675129B2

(12) United States Patent
Leedom et al.

(10) Patent No.: US 9,675,129 B2
(45) Date of Patent: Jun. 13, 2017

(54) HELMET WITH VENT OPENING CONTROL

(71) Applicant: Bern Unlimited, Inc., Kingston, MA (US)

(72) Inventors: Dennis J. Leedom, Duxbury, MA (US); Ryan Stephen Melofchik, Allston, MA (US); Adam M. Godwin, Duxbury, MA (US)

(73) Assignee: BERN UNLIMITED, INC., Kingston, MA (US)

( * ) Notice: Subject to any disclaimer, the term of this patent is extended or adjusted under 35 U.S.C. 154(b) by 234 days.

(21) Appl. No.: 14/557,015

(22) Filed: Dec. 1, 2014

(65) Prior Publication Data

US 2016/0150845 A1 Jun. 2, 2016

(51) Int. Cl.
*A42B 3/28* (2006.01)
*A42C 5/04* (2006.01)

(52) U.S. Cl.
CPC ..... *A42B 3/283* (2013.01); *A42B 3/28* (2013.01); *A42C 5/04* (2013.01)

(58) Field of Classification Search
CPC ..... A42B 3/28; A42B 3/283; A42B 3/281; A42B 3/286; A42B 3/285; A42B 1/008; A42B 3/06; A42B 3/12; A42B 3/125; A42B 3/127; A42C 5/04; A42C 5/00
USPC ..... 2/171.3, 171.4, 171.7, 5, 6.1, 6.6, 7, 414
See application file for complete search history.

(56) References Cited

U.S. PATENT DOCUMENTS 789,301 A * 5/1905 Vance ..... A42C 5/04 2/171.7
934,508 A * 9/1909 Deely ..... A42C 5/04 2/171.7
4,558,470 A * 12/1985 Mitchell et al. ..... A42B 3/124 2/414
4,612,675 A * 9/1986 Broersma ..... A42B 3/12 2/171.3
4,731,885 A * 3/1988 Nava ..... A42B 3/283 2/171.3
4,964,178 A * 10/1990 Giancarlo ..... A42B 3/281 2/171.7
4,995,117 A * 2/1991 Mirage ..... A42B 3/0493 2/410
5,170,511 A * 12/1992 Kamata ..... A42B 3/283 2/171.3
5,388,277 A * 2/1995 Taniuchi ..... A42B 3/283 2/171.3
5,388,278 A * 2/1995 Taniuchi ..... A42B 3/283 2/171.3
6,105,172 A * 8/2000 Shida ..... A42B 3/24 2/171.3

(Continued)

*Primary Examiner* — Amy Vanatta
(74) *Attorney, Agent, or Firm* — Lando & Anastasi, LLP

(57) ABSTRACT

A helmet includes a shell defining a ventilation aperture passing from the outer surface of the shell to the inner surface of the shell. A ventilation control is secured to the inner surface of the shell. The ventilation control is configured to be reversibly displaced between a first position blocking a flow of air through the ventilation aperture and a second position permitting flow of air through the ventilation aperture. The ventilation control is configured to be reversibly displaced between the first position and the second position by a force applied upon an outer surface of the ventilation control opposite to the inner surface of the shell from within an internal volume of the helmet.

16 Claims, 13 Drawing Sheets

(56) References Cited

U.S. PATENT DOCUMENTS

| | | | | |
|---|---|---|---|---|
| 6,317,891 | B1 * | 11/2001 | Gafforio | A42B 3/283 2/171.3 |
| 2002/0124298 | A1 * | 9/2002 | Muskovitz | A42B 3/283 2/410 |
| 2007/0130672 | A1 * | 6/2007 | Beddoe | A42B 3/125 2/410 |

* cited by examiner

HELMET WITH VENT OPENING CONTROL

BACKGROUND

1. Technical Field

Aspects and embodiments of the present invention are directed generally to helmets, and more particularly to sports helmets including ventilation features.

2. Discussion of Related Art

Sports helmets are used in many sports for protecting the head of a wearer. Such sports may include, for example, biking, skiing, hockey, lacrosse, and football, and so-called "extreme sports" which may include snowboarding, rock or ice climbing, and skydiving.

In some examples, a sports helmet may include an outer shell designed to provide strength and rigidity for impact resistance and an inner pad mounted to an inner surface of the outer shell and configured to contact the head of a wearer. A sports helmet may protect the head of a wearer by providing impact resistance and/or by absorbing shocks when the helmet is impacted. The outer shell of a sports helmet is, in some examples, made of rigid material such as a hard plastic to facilitate impact resistance, for example, to distribute a force from a point impact across a large area of the shell of the helmet, while the inner pad is made of a resilient shock-absorbing material such as a polymeric foam.

In some examples, sports helmets include one or more ventilation openings which may provide for air to pass through the outer shell and inner pad of the helmet to assist in the dissipation of heat from the head of a wearer of the helmet.

SUMMARY

In accordance with an aspect of the present disclosure, there is provided a helmet. The helmet comprises a shell including an outer surface and an inner surface. The shell defines a ventilation aperture passing from the outer surface of the shell to the inner surface of the shell. The helmet further comprises a ventilation control secured to the inner surface of the shell and configured to be reversibly displaced between a first position blocking a flow of air through the ventilation aperture and a second position permitting flow of air through the ventilation aperture. The ventilation control is configured to be reversibly displaced between the first position and the second position by a force applied upon an outer surface of the ventilation control opposite to the inner surface of the shell from within an internal volume of the helmet.

In some embodiments, the ventilation control is not operable from outside of the helmet.

In some embodiments, the ventilation control is configured to maintain a to position in one of the first position, the second position, and an intermediate position between the first position and the second position in the absence of a force applied by a user of the helmet to the ventilation control.

In some embodiments, the ventilation control comprises a slider plate assembly slidably mounted to the inner surface of the shell.

In some embodiments, the helmet further comprises a slider mount assembly including an anchor clip fixedly retained between the outer surface of the shell and the inner surface of the shell, the slider plate assembly slidably mounted to the anchor clip. The slider plate assembly may comprise a slider plate including a slider plate body defining a channel, the channel defining a range of displacement of the slider plate assembly.

In some embodiments, the helmet further comprises a connection boss including a connection boss body disposed against a side of the slider plate opposite the inner surface of the shell and a connection boss arm passing through the channel and coupled to the anchor clip.

In some embodiments, the helmet further comprises a boss plate disposed between the slider plate and the inner surface of the shell, the connection boss arm passing through an aperture defined in the boss plate. The slider plate may contact an inner surface of the boss plate and is configured to be slidably displaced across the inner surface of the boss plate. The slider plate may be positioned between the body of the connection boss and the boss plate.

In some embodiments, the helmet further comprises a top pad including a shock-absorbing material affixed to a side of the slider plate opposite the inner surface of the shell.

In some embodiments, the helmet further comprises a shock absorbing padding affixed to the inner surface of the outer shell, a path of travel of the slider plate assembly on the inner surface of the shell between the first position and the second position being free of the shock absorbing padding.

In some embodiments, the ventilation control includes a plurality of apertures passing therethrough, each of the plurality of apertures configured and arranged to to block a respective ventilation aperture when the ventilation control is in the first position and to not block the respective ventilation aperture when the ventilation control is in the second position.

In accordance with another aspect, there is provided a sports helmet. The sports helmet comprises an outer shell including an internal side and an external side and defining a cavity configured to receive a head of a wearer and a ventilation control mounted to an inner side of the outer shell and configured to be reversibly displaced between a first position permitting a flow of air through a ventilation aperture defined in the outer shell and a second position blocking the flow of air through the ventilation aperture. The ventilation control is configured to be displaced between the first position and the second position by application of a force to the ventilation control from within the cavity.

In some embodiments, the ventilation control is not operable when the helmet is disposed on the head of the wearer.

In some embodiments, the sports helmet further comprises a securing mechanism slidably securing the ventilation control to the internal side of the outer shell.

In some embodiments, the ventilation control includes a slider aperture block defining a slider aperture.

In some embodiments, the sports helmet further comprises a connection boss having an arm passing through the slider aperture and secured to an anchor clip embedded in the outer shell.

In some embodiments, the sports helmet further comprises a boss plate disposed between the slider aperture block and the anchor clip.

In some embodiments, the ventilation control is rotatably mounted to an inner side of the outer shell and is configured to be reversibly rotatably displaced between the first position and the second position.

In accordance with another aspect, there is provided a ventilation control system for a helmet. The ventilation control system comprises a slider plate including an aperture block defining a slider aperture, a top pad including a shock-absorbing material secured to a lower surface of the slider plate, a connection boss having a to body frictionally engaging the lower surface of the slider plate and including an arm passing through the slider aperture, a boss plate frictionally engaging an upper surface of the slider plate and defining an aperture through which the arm of the connection boss passes, and an anchor clip receiving an end of the arm of the boss plate and embedded in a shell of the helmet. The ventilation control system is not operable from outside of the helmet.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
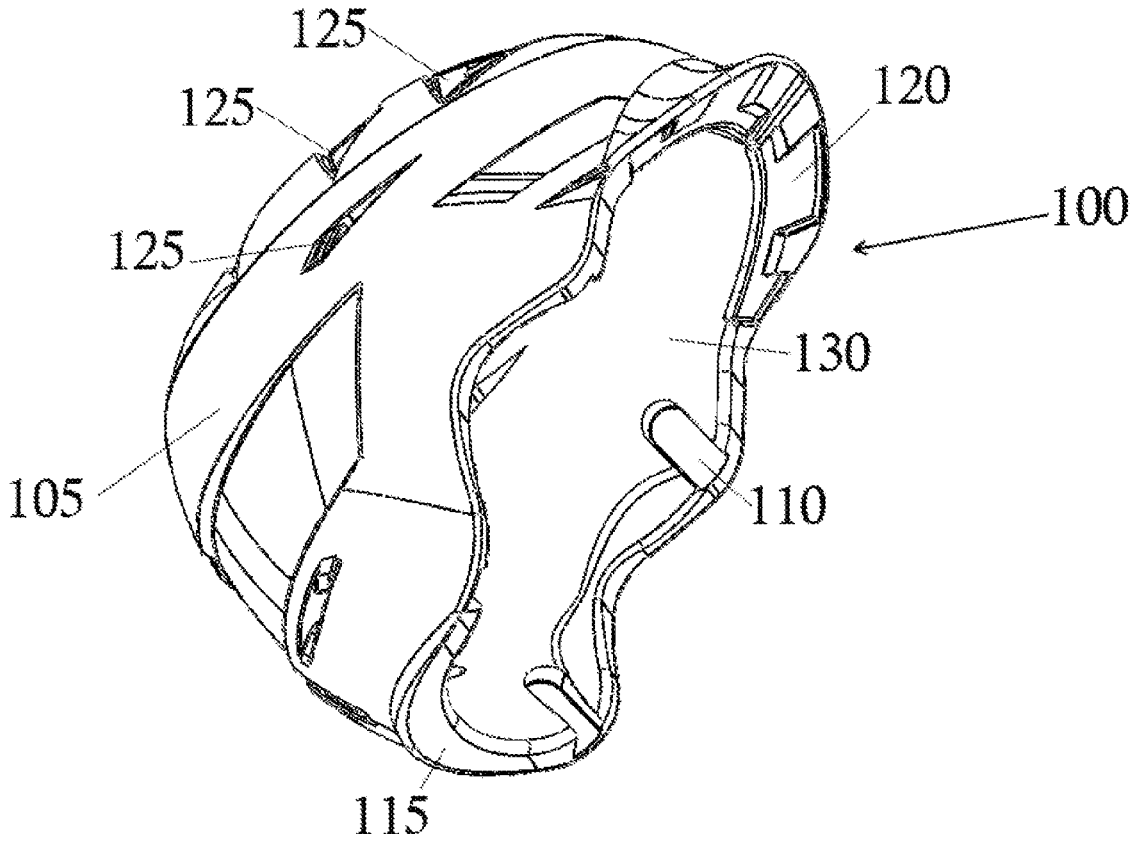
FIG. 1 is a perspective view of an embodiment of a helmet.

Aspects and embodiments disclosed herein are not limited to the details of construction and the arrangement of components set forth in the following description or illustrated in the drawings. The disclosed aspects and embodiments are capable of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional items.

The present disclosure will be described with reference to sports helmets, referred to herein synonymously as "sports helmets" or simply "helmets," although it should be understood that aspects and embodiments disclosed herein may equally apply to other forms of headgear or helmets, for example, hard hats, uniform hats, baseball caps, and other forms of head gear.

It is often desirable to a wearer of a helmet that the helmet provide sufficient protection to the head of the wearer to justify any inconvenience associated with wearing the helmet. A wearer may desire that a helmet provide both impact resistance and shock absorbance protection appropriate for the form of activity which the wearer wishes to engage in while wearing the helmet. The degree of protection a helmet offers a wearer may in some examples be required to satisfy certain minimum standards for the helmet to be approved by an approval body for use in different activities.

Wearers of helmets are often concerned with more than just the protective to aspects of a helmet when selecting a helmet for use while participating in their activity of choice. For example, aesthetics may play a role in a decision of a potential buyer to purchase a particular helmet. Some potential purchasers may be attracted to helmets that are sleek, streamlined, and aerodynamic, rather than bulky and poorly proportioned. Some potential purchasers may also, or alternatively, be attracted to helmets that they believe will be rugged and resistant to damage. Thus, potential purchasers may be attracted to helmets which include few external features extending or protruding from an outer surface of the helmet. The provision of few, if any, external features extending or protruding from an outer surface may provide the helmet with a more sleek and streamlined look, may provide for the helmet to have a thinner, lower profile, and may reduce the number of external features which may be subject to damage upon, for example, impact of the helmet with an object, which may snag material which the helmet may come into contact with, and/or which may add weight or manufacturing cost to the helmet.

Potential purchasers may consider it desirable that a helmet include ventilation apertures that allow for the flow of air into or out of the helmet to facilitate cooling of the head of a wearer and/or evaporation from the head of the wearer during use. These purchasers may consider it an added benefit if the ventilation apertures may be reversibly opened and closed so that the helmet may be used with the ventilation apertures closed on cold days when cooling is not necessary and with the ventilation apertures opened on warmer days when ventilation and cooling is desired. It may be desirable that the ventilation apertures or ventilation system of a helmet be easily switched from an open to a closed position, but resistant to unintentional switching between open and closed positions, for example, when the helmet is in use. It may also be desirable that the ventilation apertures or ventilation system of a helmet may be set to one or more intermediate positions between fully opened and fully closed.

Both potential purchasers and manufacturers of helmets may also desire helmets that have few independent parts, moving or otherwise, with acceptable degrees of tolerances between the parts, when assembled, so that the manufacturing and use of the helmet is simple and inexpensive. The provision of a fewer rather than a greater number of parts in a helmet ventilation control system may also desirably to reduce the overall weight of a helmet.

Aspects and embodiments disclosed herein may address one or more of the concerns and/or desires described above.

Various aspects and embodiments disclosed herein include a helmet having a ventilation system which is easily operable, resistant to unintentional switching between open and closed positions (or from a partially open position), and which does not disturb an otherwise sleek and aerodynamic shape of an external surface of the helmet. Aspects and embodiments of the helmets disclosed herein include one or more ventilation apertures passing through shells of the helmets. The ventilation apertures are selectively opened and closed, or set to a partially opened configuration which in some embodiments may be any position desirable between a fully open and fully closed configuration, by a ventilation aperture control. The ventilation aperture control may reside entirely internal to the outer shell of the helmet and be free of actuators or other features extending from the outer surface of the helmet where they may disturb the aesthetics and/or aerodynamics of the helmet or result in the other disadvantages discussed above.

The ventilation aperture control may be operable from within the helmet but not from outside of the helmet. In some embodiments, the ventilation aperture control is accessible and operable prior to a user putting on a helmet and/or upon removal of the helmet from the user's head but not while the user is wearing the helmet.

The ventilation aperture control may include a feature which slides into a first position allowing air to pass through one or more ventilation apertures in the helmet and into a second position blocking air from flowing through the one or more ventilation apertures. The feature may also slide into one or more intermediate positions between the first position and the second position, partially obstructing flow of air through the one or more ventilation apertures. The sliding feature may encounter sufficient friction against other parts of the helmet when in the first and/or second and/or intermediate position such that it is resistant to movement from the position in which it is set absent a manual force applied by the user of the helmet.

A perspective view of a helmet 100 in accordance with various aspects and embodiments disclosed herein is shown in FIG. 1. The helmet 100 includes a body or shell having an outer shell 105 and an inner shell 110. The outer shell 105 and inner shell 110 are collectively referred to herein as "the shell" of the helmet. The outer shell 105 and inner shell 110 may be substantially concentric and may be displaced from one another by a small distance, for example, between about 0 cm and about 4 cm. This distance may vary with location on the helmet and may in some embodiments be less than about 0.5 cm or greater than about 4 cm. The spacing between the outer shell 105 and inner shell 110 is in some embodiments filled with an impact absorbing material, for example, an expanded polymeric foam that may facilitate dampening impact forces travelling from the outer shell 105 to the inner shell 110. The outer shell 105 and inner shell 110 may be joined by a bridge 115 on a lower portion thereof, although in some embodiments, the outer shell 105 and inner shell 110 are formed so that they smoothly transition into one another and a separate bridge section 115 is not easily identifiable. In some embodiments, one or more of the outer shell 105, inner shell 110, and/or bridge 115 may be shaped into a visor 120 at a forward portion of the helmet 100. In some embodiments, the helmet 100 may not have a separate inner shell 110, but rather may have an internal surface defined by impact absorbing material coupled to the outer shell 105 and/or padding disposed on the impact absorbing material. In such embodiments, the inner shell 110 may be considered the inner surface of the impact absorbing material coupled internally to the outer shell 105.

One or more ventilation apertures 125 are defined in the body or shell of the helmet 100. The ventilation apertures 125 are voids passing from the outer shell 105 to the inner shell 110 and are defined by openings formed in the outer shell 105 and the inner shell 110. The ventilation apertures 125 allow for air to pass through the outer shell 105 and the inner shell 110 of the helmet 100 to cool the head of a wearer of the helmet 100 and/or allow sweat or water vapor to pass form the wearer's head out through the body or shell of the helmet.

An internal surface of the inner shell 110 may be at least partially covered with a layer of an impact absorbing material 130, also referred to herein as "padding." The impact absorbing material 130 may facilitate proper fit and comfort of the helmet on the head of a wearer. The impact absorbing material 130 may cover a majority of to the surface area of the internal surface of the inner shell 110 and may provide protection against both horizontal and lateral impacts. The impact absorbing material 130 may be a polymeric foam, a bed or pillow-like layer of a natural or synthetic material, or any other material known for use in padding for sporting goods. The impact absorbing material 130 may be resilient and able to deform upon application of a force, for example, an impact to the helmet, but quickly return to its original shape. The impact absorbing material 130 may be sufficiently rigid to maintain its shape absent the application of an external force but compliant enough to mold to the contours of a particular wearer's head. The impact absorbing material 130 may be water absorbent, and may wick moisture away from a wearer's head while in use. The impact absorbing material 130 may have a thickness depending on the material(s) of which it is constructed and the magnitude of impact the helmet is designed to protect a wearer from. For example, the impact absorbing material may have a thickness of up to about 2 cm, for example, between about 0.5 mm and about 2 cm. The ventilation apertures 125 defined in the body or shell of the helmet 100 may continue through the impact absorbing material 130 and may provide a path for air to flow from outside of the helmet to a region internal to a cavity or volume defined by the body or shell of the helmet 100 and/or the layer of impact absorbing material 130.

In some embodiments, the helmet 100 may include additional features not shown, for example, one or more straps attached to various portions of the helmet 100 which may be utilized to secure the helmet 100 to the head of a wearer when in use.

In some embodiments, the helmet 100 may include a ventilation control system configured to selectively allow and prevent air flow through at least one ventilation aperture 125 of the helmet 100. The ventilation control system may include a ventilation control element that may be reversibly displaceable between a first or "closed" position covering or blocking flow of air through at least one ventilation aperture 125 and a second or "open" position allowing flow of air through the at least one ventilation aperture 125. The ventilation control element may also be placed and may maintain position in a "partially open" position in which it partially blocks at least one ventilation aperture 125. The ventilation control element may to cover or block all ventilation apertures 125 in the helmet when in the closed position, or only a subset (for example, as few as one) of the ventilation apertures 125 in the helmet when in the closed position. The ventilation control element may be reversibly displaced between the open and closed positions, or to a position intermediate between the open and closed positions, for example, the partially open position, by an action performed on the ventilation control element by a user of the helmet 100. In some embodiments, the helmet 100 may include multiple ventilation control elements, each configured and arranged to be reversibly displaced between open, closed, and one or more intermediate positions to at least partially block or allow flow of air through at least one ventilation aperture 125.

Figure 2:
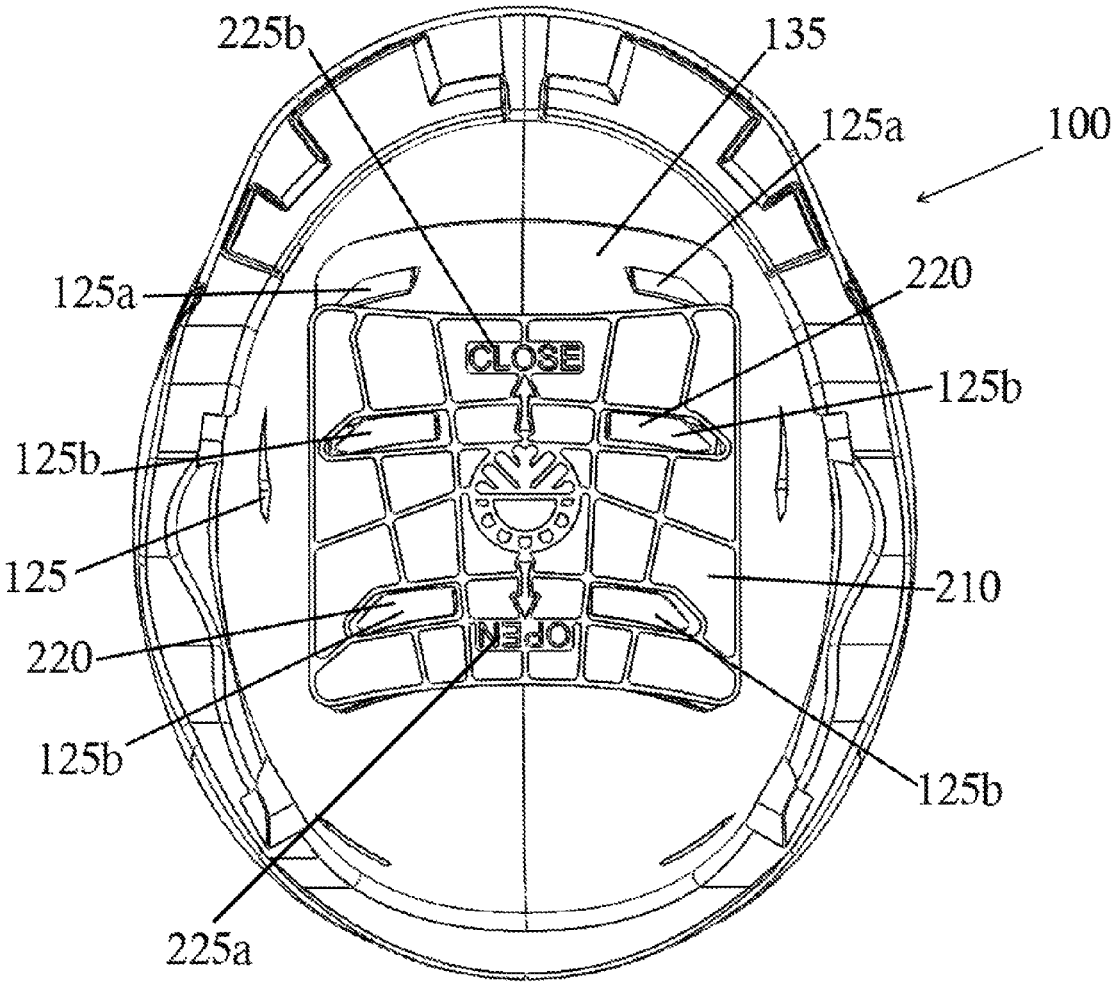
FIG. 2 is plan view of an internal upper surface of the helmet of FIG. 1 illustrating an embodiment of a ventilation control system in an open position.

An embodiment of a ventilation control system including a ventilation control element 210 in an open position is illustrated in FIG. 2, which is a view upward toward an internal upper portion of the helmet 100. The ventilation control element 210 includes a plate-like structure which is displaceable along a channel or track 135 defined in the upper internal portion of the helmet. The channel or track 135 may be defined by an area on the upper internal portion of the helmet which is not covered by the impact absorbing material 130. The ventilation control element 210 may include labels 225*a*, 225*b* indicating which direction along the track corresponds to an open and to a closed position for the ventilation control element 210. In the open position illustrated in FIG. 2, the ventilation control element 210 does not block or at least does not substantially block ventilation apertures 125*a* due to the position of the ventilation control element 210. The ventilation control element 210 includes a plurality of ventilation control apertures 220 passing through the ventilation control element 210. These ventilation control apertures 220 align with ventilation apertures 125*b* when the ventilation control element 210 is in the open position, providing for air to pass through the ventilation control element 210 and ventilation apertures 125*b*. Additional ventilation apertures 125 displaced from the track 135 may remain unobstructed by the ventilation control element 210 regardless of its position.

Figure 3:
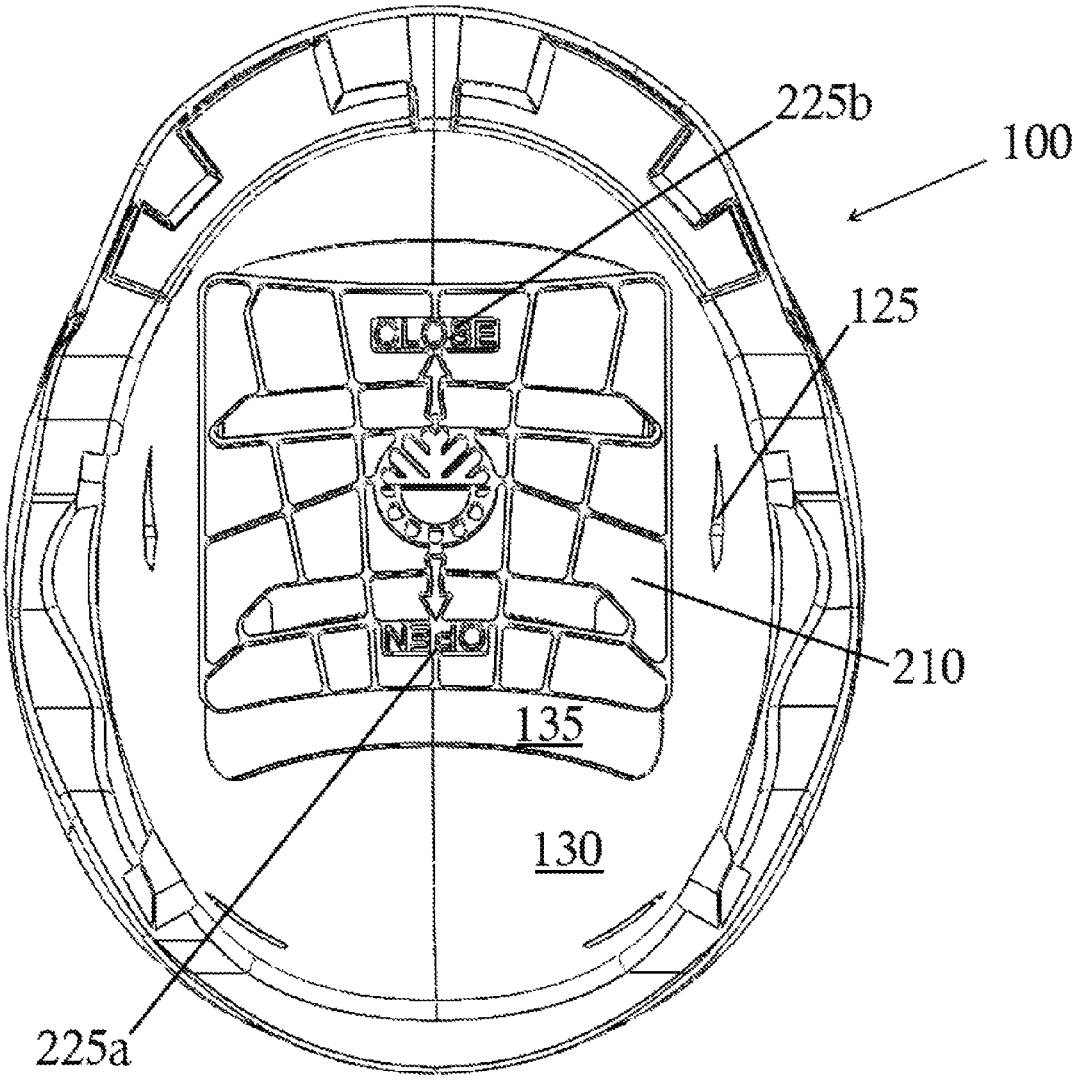
FIG. 3 is plan view of an internal upper surface of the helmet of FIG. 1 illustrating the ventilation control system in a closed position.

The ventilation control element 210 is illustrated in a closed position in FIG. 3. In FIG. 3, the ventilation control element 210 has been displaced along the track 135 in the direction of the arrow in the "CLOSE" label 225*b*. In the closed position to illustrated in FIG. 3, the ventilation control element 210 blocks each of ventilation apertures 125*a* and 125*b* and blocks the flow of air through these apertures. Ventilation apertures 125*a* and 125*b* are not visible in FIG. 3 because they are covered by the ventilation control element 210.

An embodiment of a structure and mounting mechanism for the ventilation control element 210 is illustrated in further detail in FIGS. 4-7. The ventilation control element 210 includes a slider plate 410 and a top pad 420 disposed on the slider plate. It is the outer surface 425 of the top pad 420 which includes labels 225*a* and 225*b* and which is visible in FIGS. 2 and 3. The top pad 420 is in some embodiments permanently adhered to the slider plate 410 with, for example, an adhesive. In other embodiment, the top pad is releaseably secured to the slider plate 410, for example, with hook and loop fasteners so that it can be removed and replaced if damaged or if it becomes soaked in perspiration. In some embodiments, the top pad 420 is formed from an impact absorbing material. The impact absorbing material of the top pad 420 may be similar or the same as the material of the impact absorbing material 130 disposed on the inner surface of the inner shell 110, although in some embodiments, the material of the top pad 420 and that of the impact absorbing material 130 may differ. For example, in some embodiments, a user may reposition the ventilation control element 210 from one position to another by manipulating (pushing or pulling) on or against the top pad 420. The top pad 420 may thus include a covering or material which is more resistant to wear, tear, or degradation by other means due to such manual manipulation than a portion or all of the impact absorbing material 130. The top pad 420 may further include finger indentations or recesses to facilitate repositioning of the ventilation control element 210 by a user. Additionally or alternatively, one or more other types of actuation assistance devices, for example, one or more pull tabs, which may be formed from, for example, lengths of a fabric material, may be coupled to the top pad 420 and/or slider plate 410 to facilitate repositioning of the ventilation control element 210. The top pad 420 may include writing or other idicia molded in a surface thereof to provide information, for example, a size of the helmet, a logo, or a wearer's name.

The slider plate 410 is in some embodiments a frame of material, for example, a plastic, metal, or plastic coated metal material. The frame of the slider plate 410 may define openings 430 sized sufficiently large so as not to interfere with the passage of air through the ventilation control apertures 220 and apertures 125*a* and 125*b* when the ventilation control element 210 is in an open position in a helmet.

Figure 4:
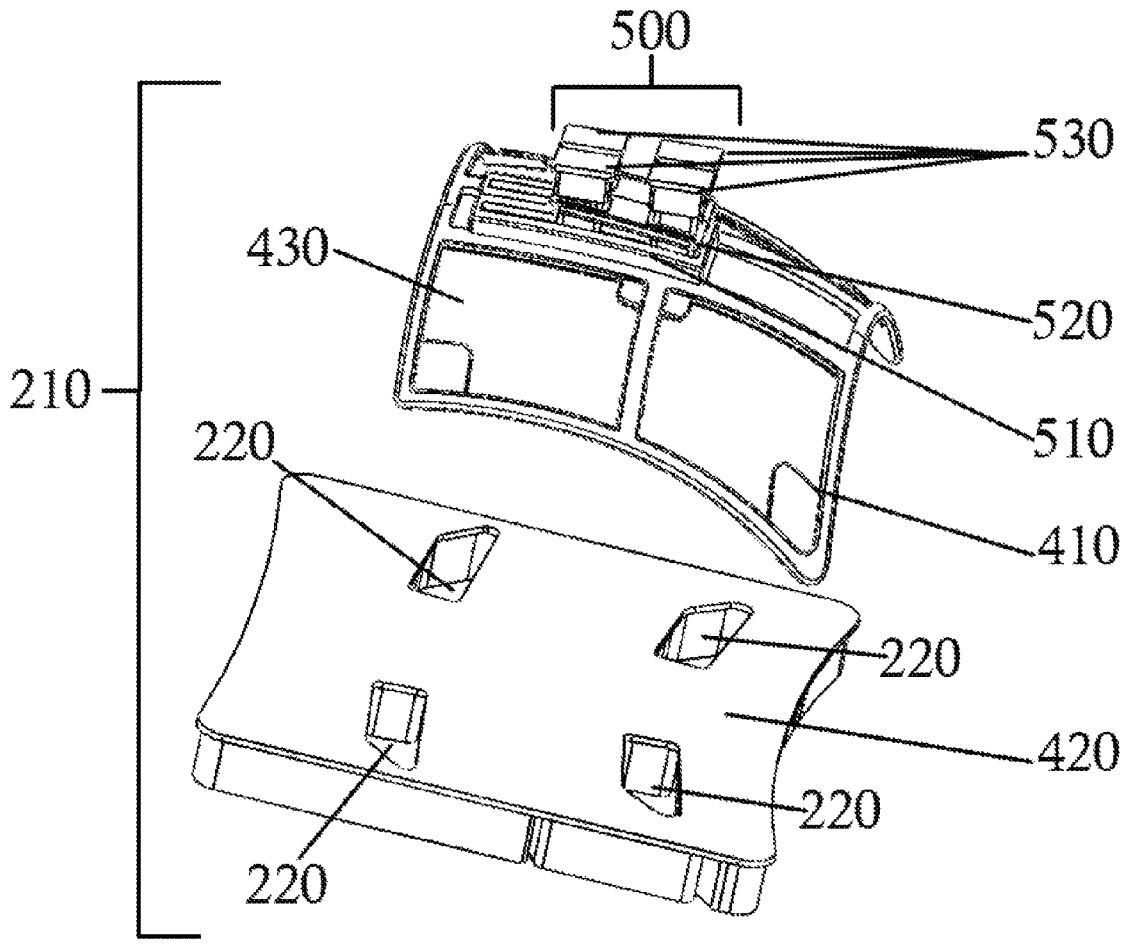
FIG. 4 is a partially exploded perspective view of an embodiment of the ventilation control system of FIG. 2 and FIG. 3.
Figure 5:
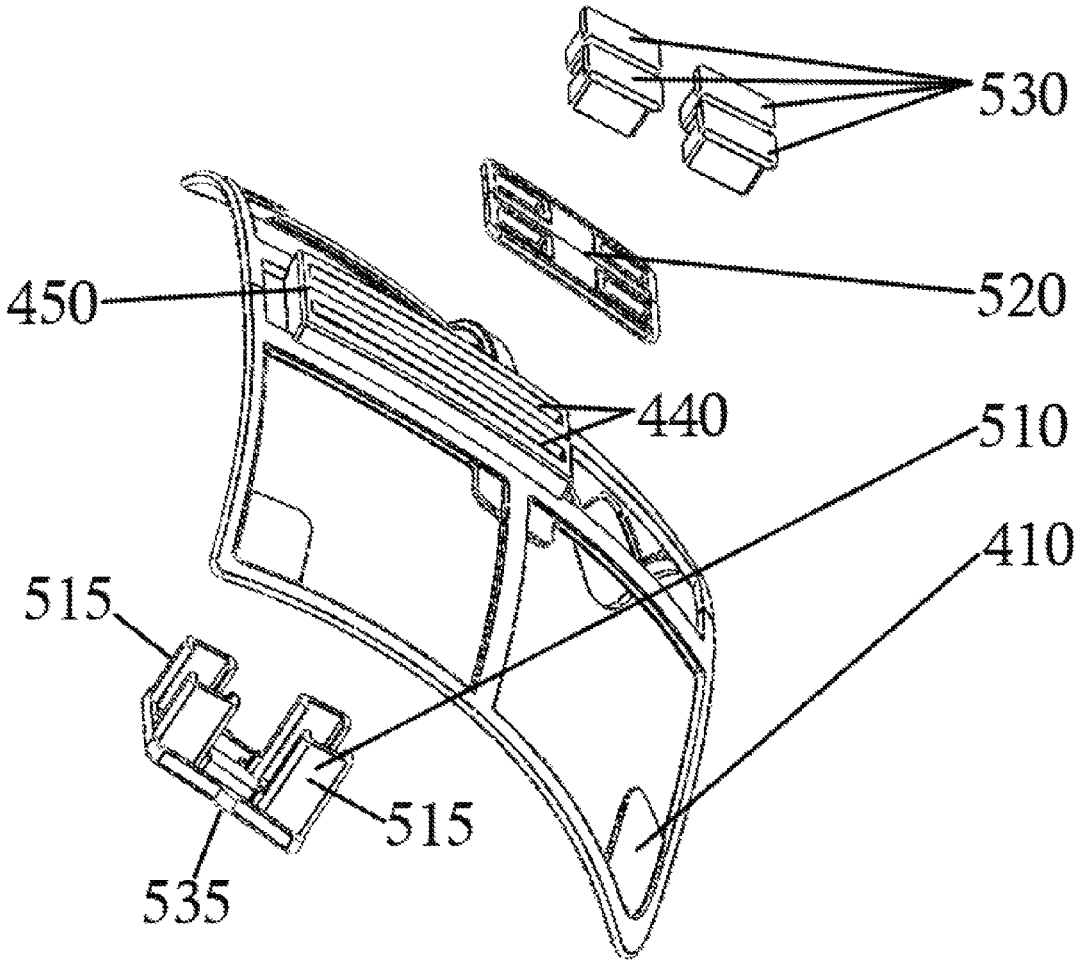
FIG. 5 is an exploded view of a portion of the ventilation control system of FIG. 4.
Figure 6:
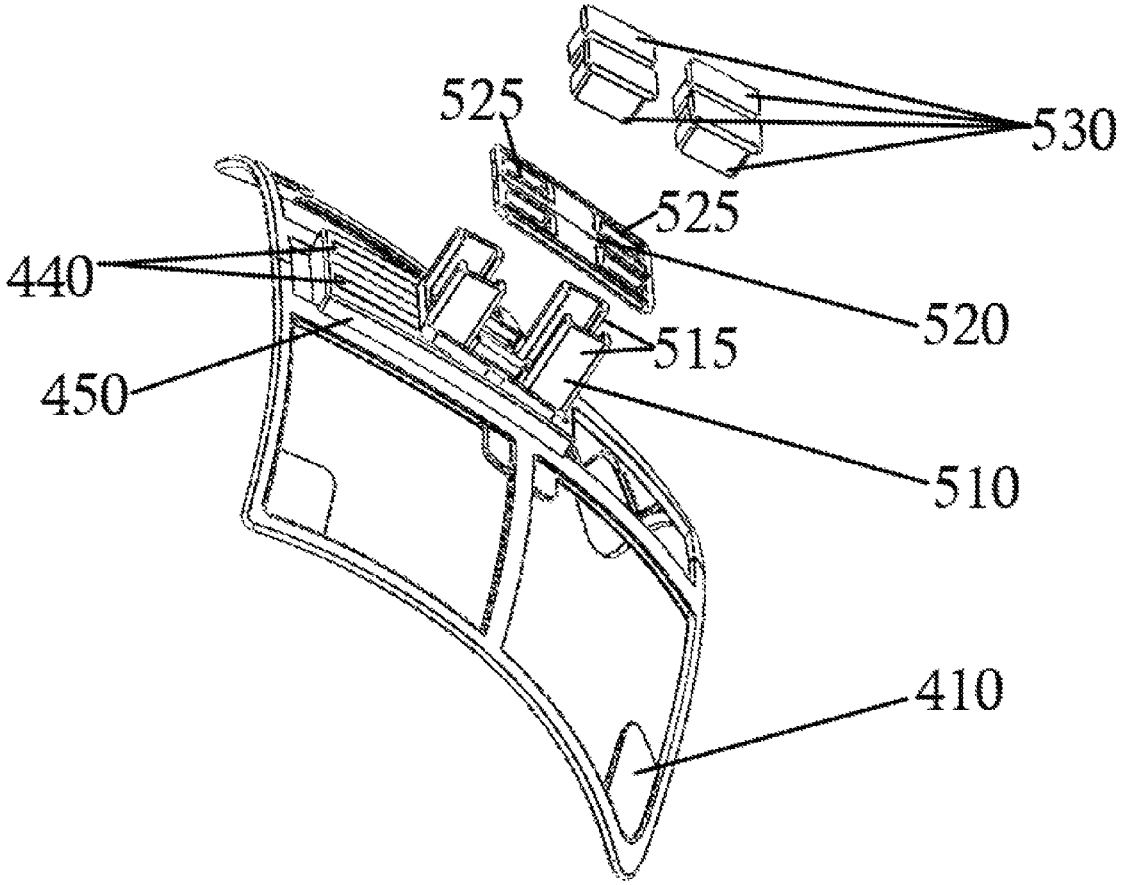
FIG. 6 is a partially assembled perspective view of the portion of the ventilation control system of FIG. 5.
Figure 7:
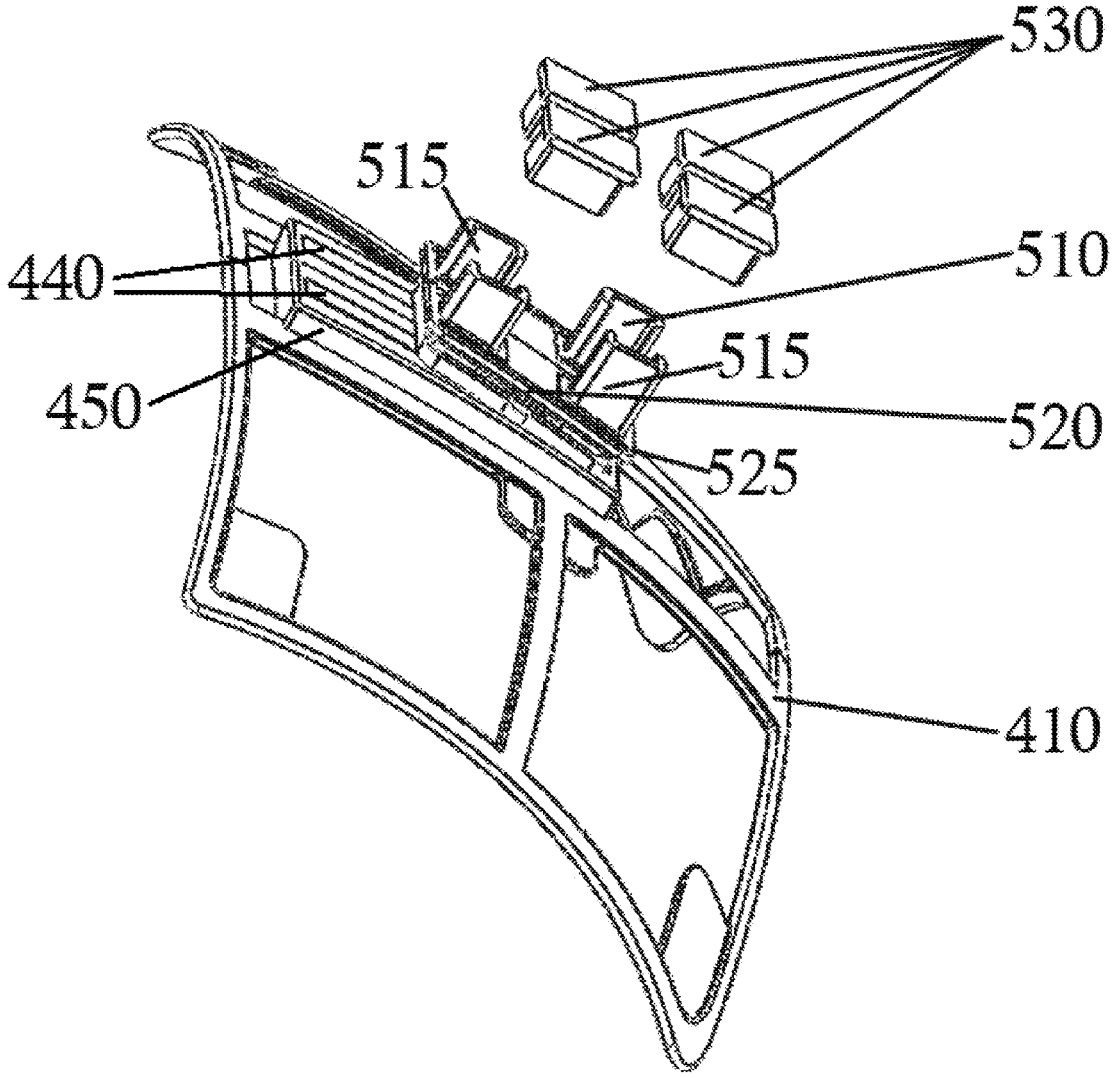
FIG. 7 is a partially assembled perspective view of the portion of the ventilation control system of FIG. 5.

The ventilation control element 210 is secured to the inner surface of a helmet 100 by a securing mechanism 500, illustrated as assembled in FIG. 4, but in various states of disassembly in FIGS. 5, 6, and 7. The securing mechanism 500, in some embodiments, includes a connection boss 510, boss plate 520, and anchor clips 530.

The ventilation control element 210 is mounted on the securing mechanism by arms 515 of the connection boss 510 which pass through slider apertures or channels 440 defined in a slider aperture block 450 on the slider plate 410. The securing mechanism 500 is illustrated in an exploded view in FIG. 5, and with the arms 515 of the connection boss 510 extending through the slider apertures channels 440 in FIG. 6. As shown in FIG. 7, the arms 515 of the connection boss 510 also extend through apertures 525 defined in the boss plate 520 so that the slider aperture block 450 (and the slider plate 410 as a whole) is sandwiched or positioned between the boss plate 520 and a body portion 535 of the connection boss 510. End portions of the arms 515 of the connection boss 510 opposite the body 535 of the connection boss 510 are secured in recesses defined in the anchor clips 530, for example, with an adhesive or a mechanical mechanism such as a snap, screw, tab, pin, or other mechanism known in the art. The anchor clips 530 are secured in place in the shell of the helmet 100, for example, in a filler material between the outer shell 105 and inner shell 110. Alternatively, the anchor clips may be secured directly to one of the outer shell 105 and the inner shell 110 and/or formed integral with one of the outer shell 105 and the inner shell 110.

In use, the securing mechanism 500 is held in place relative to the remainder of the helmet 100 by the anchor clips. The slider plate 410 slides between the body 535 of the connection boss 510 and the boss plate 520 into positions in which the top pad 420 blocks, partially blocks, or does not block flow of air through ventilation apertures in the shell of the helmet. The range of movement of the slider plate is limited by the length of the slider apertures or channels 440 through which the arms to 515 of the connection boss 510 pass. No element of the securing mechanism or of the ventilation control element 210 or any actuator for the ventilation control element 210 extends outside of the helmet 100.

The various parts included in the securing mechanism 500, for example, any one or more of the anchor clips 530, boss plate 520, connection boss 510, slider plate 410, and top pad 410 may be formed from lightweight and flexible materials, for example, one or more thermoplastic or thermoset polymers. The various parts included in the securing mechanism 500 may have a degree of flexibility that allows them to conform to contours of the head of a helmet wearer so that they do not interfere with or otherwise cause discomfort to the helmet wearer. The surfaces of parts which slide against one another, for example, the lower side of the connection boss 510 and upper portion of the slider aperture block 450 may be sufficiently smooth to allow the ventilation control element 210 to be easily repositioned by a user, but exhibit sufficient friction against one another and/or other portions of the helmet so that the ventilation control element 210 may be frictionally engaged in place and not move from a set position unless acted upon by a user.

It should be appreciated that other anchor mechanisms may additionally or alternatively be utilized to slidably secure the ventilation control element 210 to the inner surface of the helmet. For example, the anchor clips 530 may, in some embodiments, be supplanted with, or replaced by pins which couple to apertures defined in the arms 515 of the connection boss 510, or which take the place of the arms 515 of the connection boss 510. One or more elements of the securing mechanism 500 may be eliminated or replaced by an alternative element. The slider aperture block 450 on the slider plate 410 may include only a single channel 440 or more than two channels 440. Such alternative embodiments of the securing mechanism 500 would be apparent to one of ordinary skill in the art and are intended to be included in the present disclosure as equivalents to the disclosed securing mechanism 500.

Figure 13:
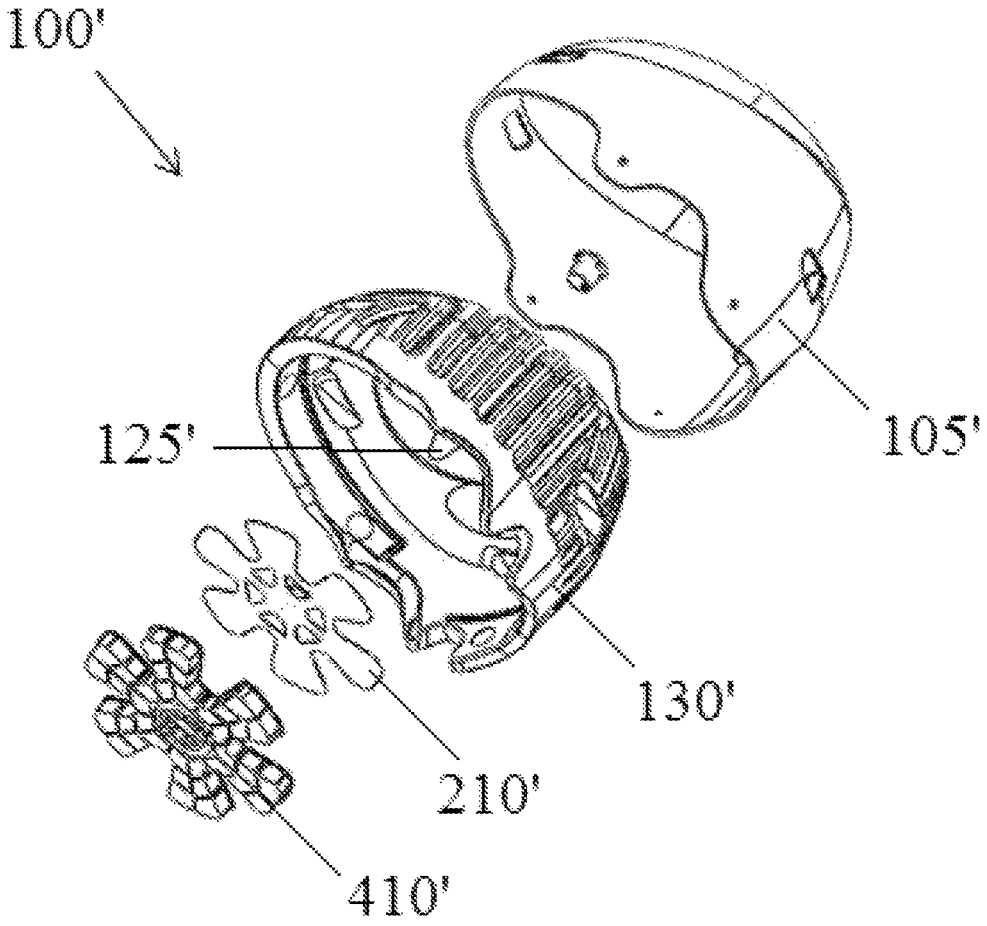
FIG. 13 is an exploded view of an embodiment of a helmet with a rotationally actuated ventilation control system.

It should also be appreciated that in some embodiments, in addition to or instead of being displaced from one position to another along a linear path, the ventilation control element may be reversibly rotationally displaced between an open to position, a closed position, and one or more intermediate positions between the open and closed positions to at least partially block or allow flow of air through at least one ventilation aperture passing through outer shell and impact absorbing material. For example, as illustrated in FIG. 13, a helmet 100' includes a ventilation control element 210', optionally including a top pad 410', which is rotatably coupled to the inner surface of the helmet 100'. The ventilation control element 210' may be rotatably coupled to the shell of the helmet 100', for example to an inner surface of the shell 105' of the helmet, at a central hub (not visible in FIG. 13). The ventilation control element 210' may be rotated between positions at least partially blocking and at least partially not obstructing one or more ventilation apertures 125'. The ventilation control element 210' may be rotated about the central hub by a full 360°, or in some embodiments, may only be rotatable through an arc of less than about 180° about the central hub. A movement path of the ventilation control element 210' may be free of and/or defined by a void in the impact absorbing material 130'. The central hub and/or force generated by the head of a wearer against the ventilation control element 210' may hold the ventilation control element 210' against the inner surface of the shell of the helmet 100' so that sufficient friction is generated between the ventilation control element 210' and the inner surface of the shell such that the ventilation control element 210' does not move or does not substantially move from a position in which it is set absent application of a manual force by the wearer of the helmet.

As the term is used herein "slidably mounted" includes both linearly displaceably mounted and rotationally displaceably mounted.

Additionally, although only a single ventilation control element 210, 210' has been illustrated for a helmet 100, 100' in the figures, it should be appreciated that the ventilation control element 210, 210' may include multiple sub-units that may be displaced in a fore and aft direction and/or a side-by-side direction from one another. One ventilation control element sub-unit may be used to reversibly open, close, or partially block one or more ventilation apertures on one region of the helmet, for example, an upper or front region, while one or more other ventilation control element sub-unit may be used to reversibly open, close, or partially block one or more other ventilation apertures on one or more other regions of the helmet, for example, side or rear regions.

Figure 8:
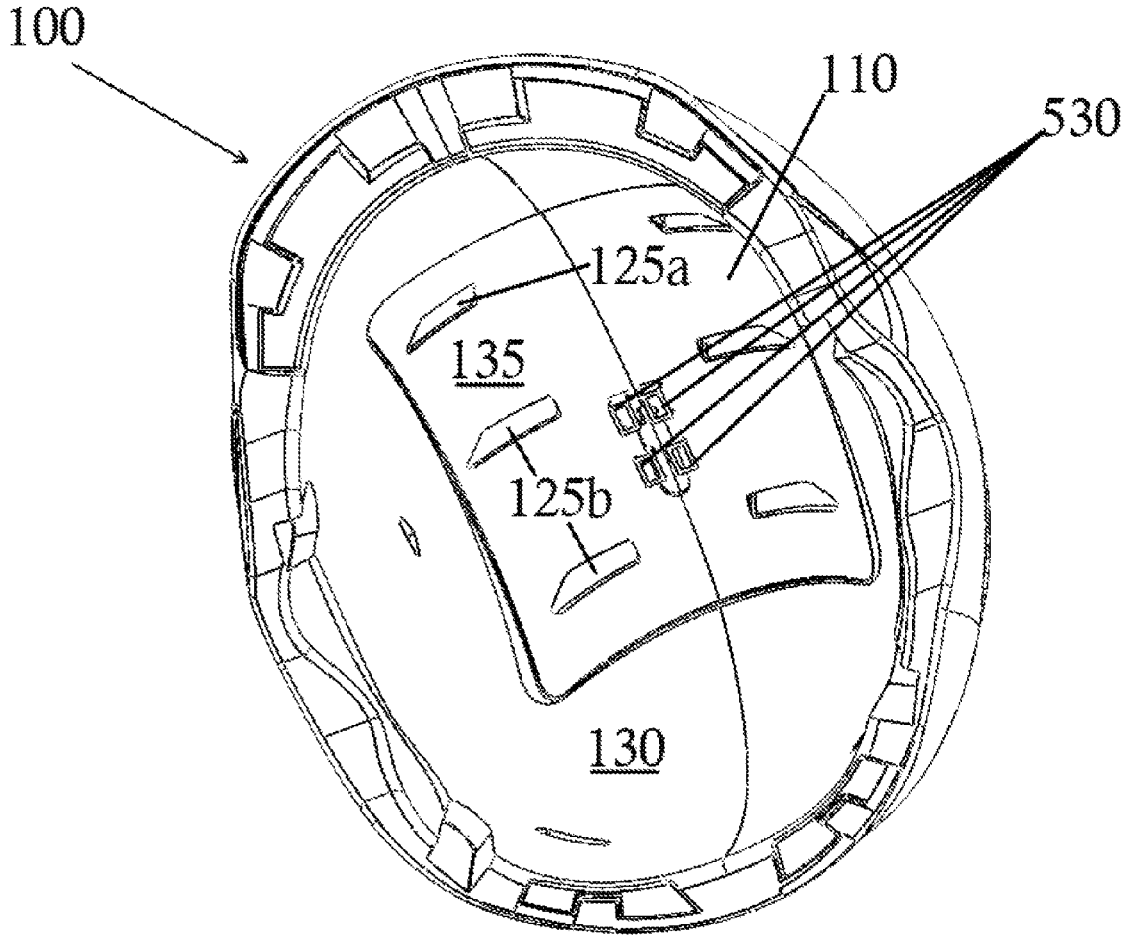
FIG. 8 illustrates the helmet of FIG. 1 including a portion of a ventilation control system installed.
Figure 9:
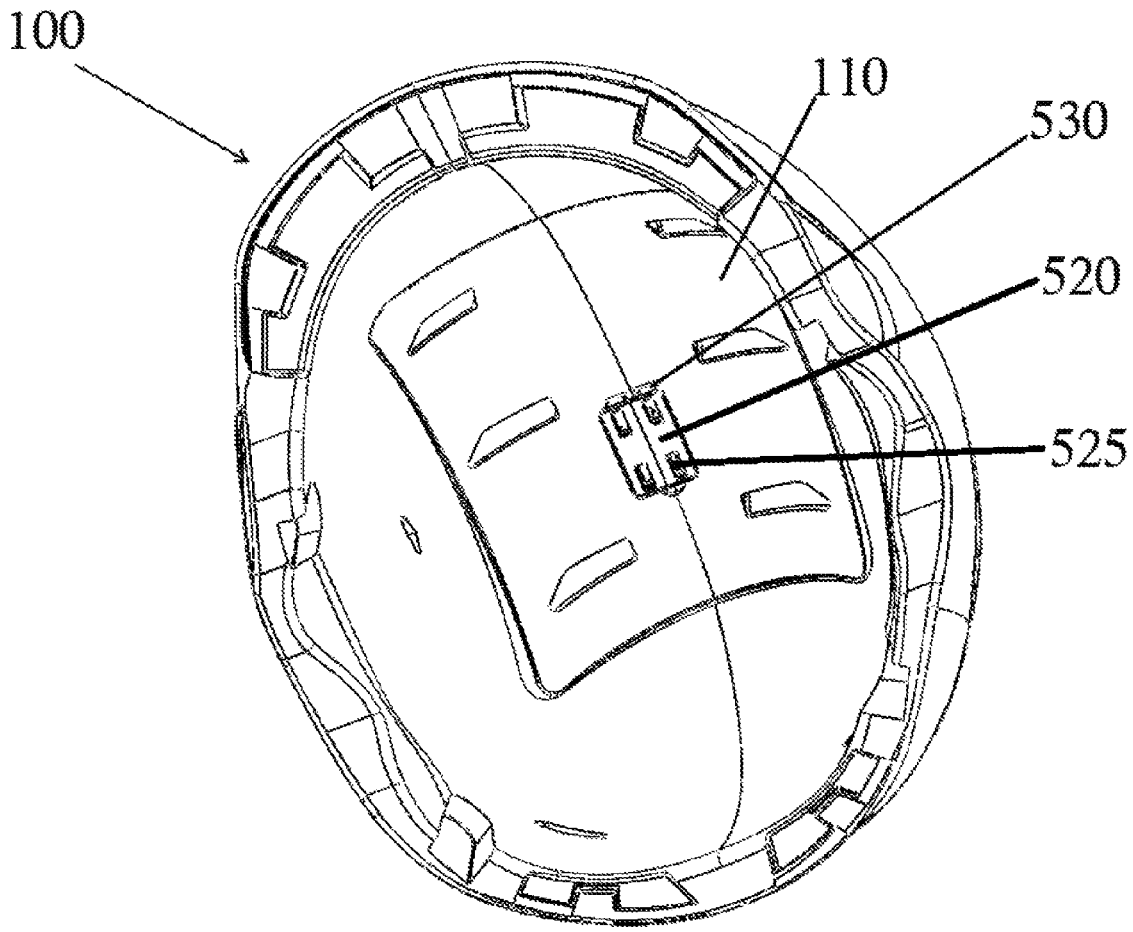
FIG. 9 illustrates the helmet of FIG. 1 including a portion of the ventilation control system installed.
Figure 10:
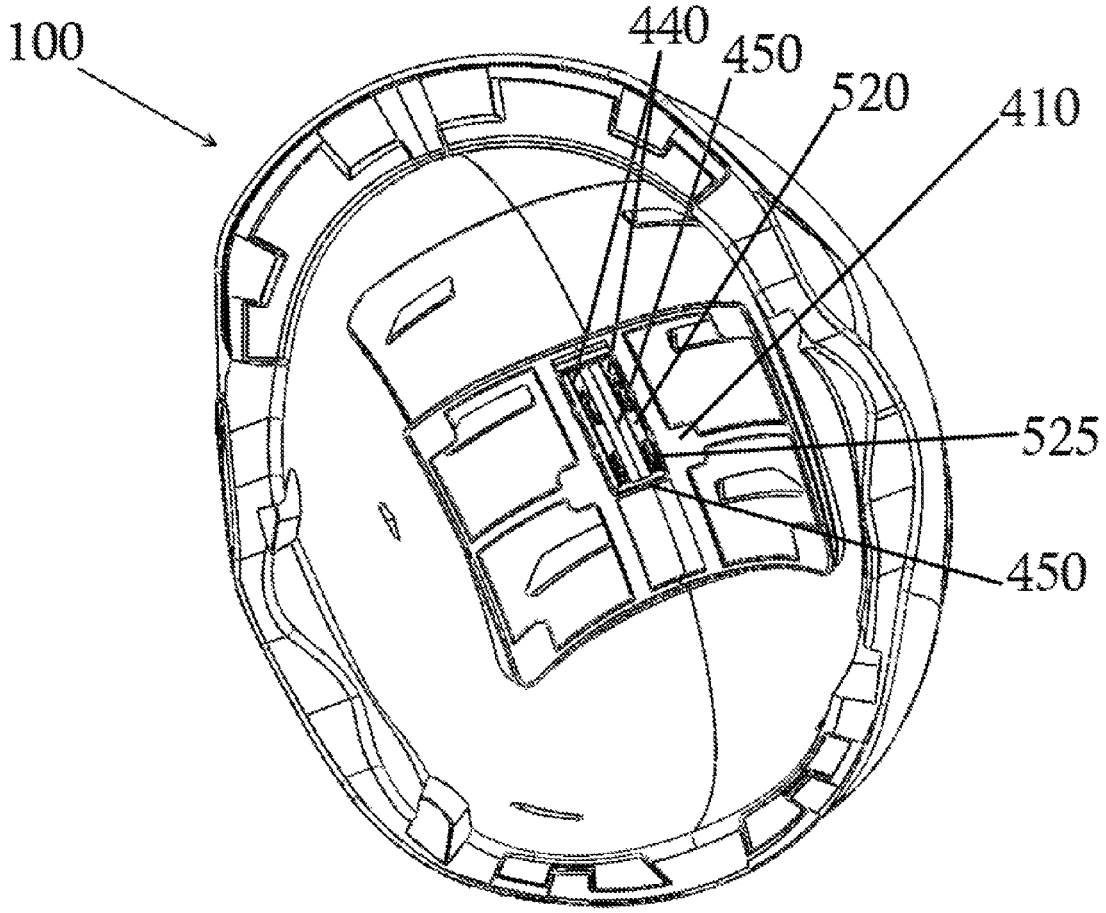
FIG. 10 illustrates the helmet of FIG. 1 including a portion of the ventilation control system installed.

An embodiment of a process for forming a helmet 100 as disclosed herein is illustrated with reference to FIGS. 8-12. FIG. 8 illustrates the shell of the helmet 100 including the anchor clips 530 disposed in material of the shell in a generally centralized location in the channel or track 135 defined by the void formed in the impact absorbing material 130 disposed on the inner surface of the inner shell 110 of the helmet 100. Ventilation apertures 125*a* and 125*b* have already been formed in the shell of the helmet 100. The anchor clips 530 are secured to the shell of the helmet 100 in different ways in different embodiments. For example, in some embodiments, the anchor clips 530 are molded in place into the material between the inner shell 110 and the outer shell 105 of the helmet 100. In other embodiments, the anchor clips 530 are formed integral with one of the inner shell 110 and the outer shell 105 of the helmet. In further embodiments, recesses are formed in the shell of the helmet 100 and the anchor clips 530 are secured in the recesses by an adhesive or a fastener, for example, a screw, clip, pin, or other fastener known in the art.

After the anchor clips 530 are formed in or secured in the shell of the helmet, the boss plate 520 is slid over the anchor clips. The apertures 525 in the boss plate 520 may be aligned with recesses in the anchor clips 530. The boss plate 520 may be disposed substantially co-planar with the inner surface of the inner shell 110 proximate the boss plate, or may rest above the inner surface of the inner shell 110. In some embodiments, a recess may be formed in the inner surface of the inner shell 110 to receive the boss plate 520.

After the boss plate 520 is positioned in place, the slider plate 410 is placed on the boss plate 520 so that an upper side of the slider aperture block 450 (the side facing the inner surface of the helmet) rests on the lower side of the boss plate 520 (the side opposite from the anchor clips 530). The channels or slider apertures 440 of the slider plate 410 are aligned with the apertures 525 in the boss plate 520. In some embodiments, a groove or track is formed in the inner surface of the inner shell 110 to accommodate and/or guide movement of the slider aperture block 450.

Figure 11:
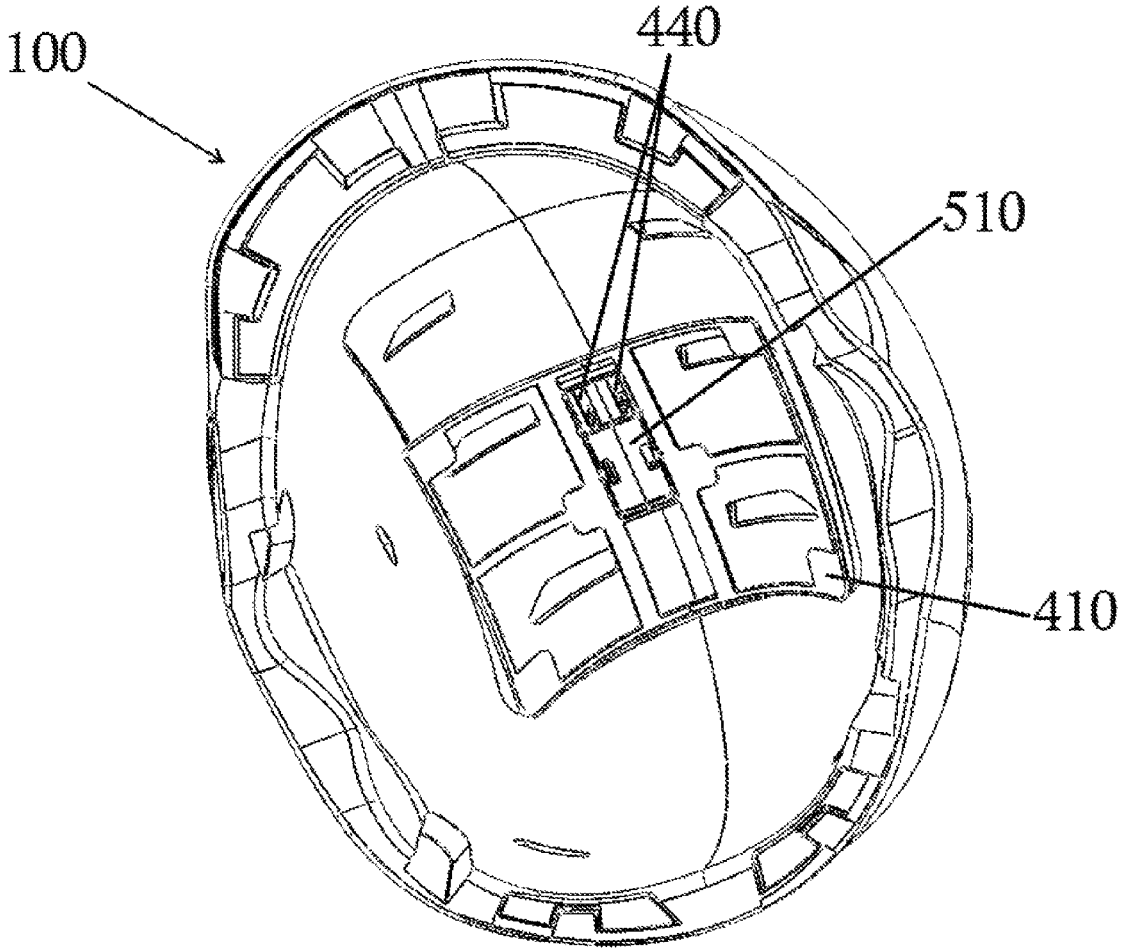
FIG. 11 illustrates the helmet of FIG. 1 including a portion of the ventilation control system installed.
Figure 12:
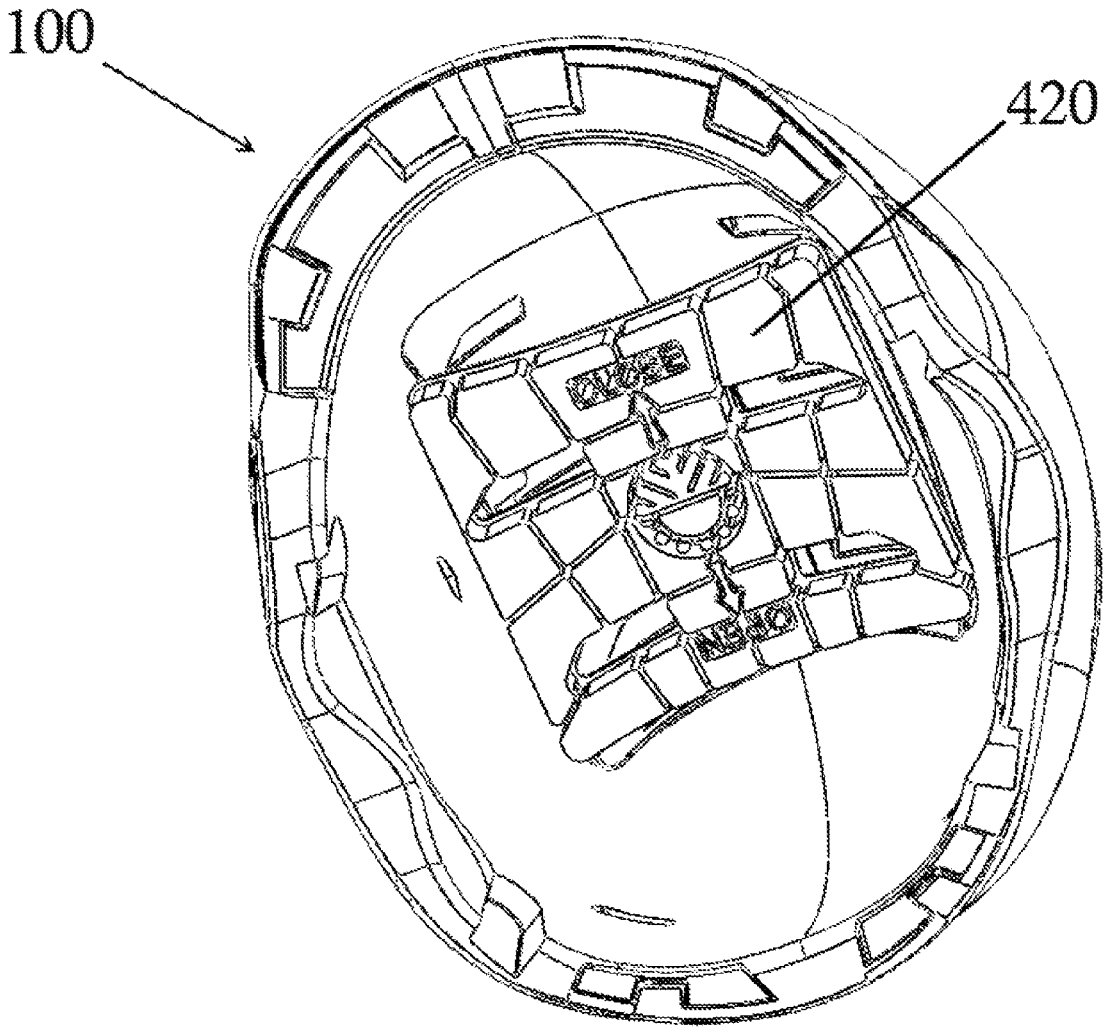
FIG. 12 illustrates the helmet of FIG. 1 with the ventilation control system installed.

Next, as illustrated in FIG. 11, the connection boss 510 is mounted on the slider plate 410. The arms 515 of the connection boss 510 (not visible in FIG. 11) pass through the slider apertures 440 of the slider plate 410 and the apertures 525 in the boss plate 520 and engage the recesses in the anchor clips 530. The arms 515 of the connection boss 510 are retained by the anchor clips 530, for example, by a mechanical snap connection or by an adhesive or by any other method known in the art. The slider plate 410 is thus mechanically secured between and frictionally engages the lower side of the boss plate 520 and an upper side of the body of the connection boss 510 (the side of the boss plate facing toward the anchor clips). Friction between the slider plate 410 and boss plate 520, connection boss 510, and/or inner surface of the inner shell 110 may be sufficient to keep the slider plate 410 from moving from a desired position unless acted upon by a user of the helmet.

After the connection boss 510 is mounted in the helmet 100, a top pad 420, which may include an impact absorbing material, for example, an elastomeric material may be mounted on the slider plate 410. The top pad may be permanently affixed to the lower side of the slider plate 410 (the side facing the internal volume of the helmet) by, for example, an adhesive or more or more screws, clips or other fasteners, or may be releasably affixed to the lower side of the slider plate 410 by, for example, hook and loop fasteners.

It should be appreciated that the acts in the method of forming the helmet illustrated in FIGS. 8-12 may be performed in the order presented or in alternate orders. For example, one or more of the boss plate 520, slider plate 410, connection boss 510 and/or anchor clips 530 may be coupled to one another prior to coupling these elements to the shell of the helmet.

Having thus described several aspects of at least one embodiment of this invention, it is to be appreciated various alterations, modifications, and improvements will readily occur to those skilled in the art. Any feature described in any embodiment may be included in or substituted for any feature of any other embodiment. Such alterations, modifications, and improvements are intended to be part of this disclosure, and are intended to be within the scope of the invention. Accordingly, the foregoing description and drawings are by way of example only.

What is claimed is:

1. A helmet comprising:

a shell including an outer surface and an inner surface, the shell defining a ventilation aperture passing from the outer surface of the shell to the inner surface of the shell; and a ventilation control secured to the inner surface of the shell and configured to be reversibly displaced between a first position blocking a flow of air through the ventilation aperture and a second position permitting flow of air through the ventilation aperture, the ventilation control configured to be reversibly displaced between the first position and the second position by a force applied upon an outer surface of the ventilation control opposite to the inner surface of the shell from within an internal volume of the helmet, the ventilation control including:

a slider plate assembly slidably mounted to the inner surface of the shell, the slider plate assembly comprising a slider plate including a slider plate body defining a channel, the channel defining a range of displacement of the slider plate assembly;

a slider mount assembly including an anchor clip fixedly retained between the outer surface of the shell and the inner surface of the shell, the slider plate assembly slidably mounted to the anchor clip; and a top pad including a shock-absorbing material affixed to a side of the slider plate opposite the inner surface of the shell;

the ventilation control configured to maintain a position in one of the first position, the second position, and an intermediate position between the first position and the second position in the absence of a force applied by a user of the helmet to the ventilation control, the ventilation control being not operable from outside of the helmet.

2. The helmet of claim 1, further comprising a connection boss including:

a connection boss body disposed against a side of the slider plate opposite the inner surface of the shell; and a connection boss arm passing through the channel and coupled to the anchor clip.

3. The helmet of claim 2, further comprising a boss plate disposed between the slider plate and the inner surface of the shell, the connection boss arm passing through an aperture defined in the boss plate.

4. The helmet of claim 3, wherein the slider plate contacts an inner surface of the boss plate and is configured to be slidably displaced across the inner surface of the boss plate.

5. The helmet of claim 4, wherein the slider plate is positioned between the body of the connection boss and the boss plate.

6. The helmet of claim 1, further comprising a shock absorbing padding affixed to the inner surface of the outer shell, a path of travel of the slider plate assembly on the inner surface of the shell between the first position and the second position being free of the shock absorbing padding.

7. The helmet of claim 1, wherein the ventilation control includes a plurality of apertures passing therethrough, each of the plurality of apertures configured and arranged to not block a respective ventilation aperture when the ventilation control is in the second position.

8. The helmet of claim 1, wherein the ventilation control is rotatably mounted to the inner surface of the shell and is configured to be reversibly rotatably displaced between the first position and the second position.

9. The helmet of claim 1, wherein the ventilation control is mounted to the inner surface of the shell and is configured to be reversibly linearly displaced between the first position and the second position.

10. A sports helmet comprising:

an outer shell including an internal side and an external side and defining a cavity configured to receive a head of a wearer; and a ventilation control mounted to an inner side of the outer shell and configured to be reversibly displaced between a first position permitting a flow of air through a ventilation aperture defined in the outer shell and a second position blocking the flow of air through the ventilation aperture, the ventilation control configured to be displaced between the first position and the second position by application of a force to the ventilation control from within the cavity, the ventilation control including:

a slider plate including an aperture block defining a slider aperture;

a top pad including a shock-absorbing material secured to a lower surface of the slider plate;

a connection boss having a body frictionally engaging the lower surface of the slider plate and including an arm passing through the slider aperture;

a boss plate frictionally engaging an upper surface of the slider plate and defining an aperture through which the arm of the connection boss passes; and an anchor clip receiving an end of the arm of the connection boss and embedded in a shell of the helmet, the ventilation control system not operable from outside of the helmet.

11. The sports helmet of claim 10, wherein the ventilation control is not operable when the helmet is disposed on the head of the wearer.

12. The sports helmet of claim 10, wherein the ventilation control is rotatably mounted to the internal side of the outer shell and is configured to be reversibly rotatably displaced between the first position and the second position.

13. The sports helmet of claim 10, wherein the ventilation control is mounted on the internal side of the outer shell and is configured to be reversibly linearly displaced between the first position and the second position.

14. A ventilation control system for a helmet, the ventilation control system comprising:

a slider plate including an aperture block defining a slider aperture;

a top pad including a shock-absorbing material secured to a lower surface of the slider plate;

a connection boss having a body frictionally engaging the lower surface of the slider plate and including an arm passing through the slider aperture;

a boss plate frictionally engaging an upper surface of the slider plate and defining an aperture through which the arm of the connection boss passes; and an anchor clip receiving an end of the arm of the connection boss and embedded in a shell of the helmet, the ventilation control system not operable from outside of the helmet.

15. The ventilation control system of claim 14, configured to maintain a position in one of a first position, a second position, and an intermediate position between the first position and the second position in the absence of a force applied by a user of the helmet to the ventilation control.

16. The ventilation control system of claim 14, wherein the slider plate includes a slider plate body defining a channel.

* * * * *